US008516627B2

(12) United States Patent
Corcoran

(10) Patent No.: US 8,516,627 B2
(45) Date of Patent: Aug. 27, 2013

(54) BATHTUB SEAT

(76) Inventor: William Corcoran, New Brunswick, NJ (US)

( * ) Notice: Subject to any disclaimer, the term of this patent is extended or adjusted under 35 U.S.C. 154(b) by 632 days.

(21) Appl. No.: 12/221,652

(22) Filed: Aug. 5, 2008

(65) Prior Publication Data

US 2010/0031436 A1 Feb. 11, 2010

(51) Int. Cl.
*A47K 3/022* (2006.01)

(52) U.S. Cl.
USPC ..... 4/578.1; 4/590

(58) Field of Classification Search
USPC ..... 4/578.1, 590, 578, 589, 584, 538, 4/573, 73.1, 565.1, 570, 560.1, 562.1, 579; 248/205.5, 205.6, 205.7, 205.8, 205.9, 206.2, 248/206.3, 206.4, 225.11
See application file for complete search history.

(56) References Cited

U.S. PATENT DOCUMENTS

| | | | | | |
|---|---|---|---|---|---|
| 1,739,163 | A | * | 12/1929 | Mitchell | 4/579 |
| 2,151,581 | A | * | 3/1939 | Bentz | 4/579 |
| 2,236,927 | A | * | 4/1941 | Thomas | 4/579 |
| 2,237,076 | A | * | 4/1941 | Kenney et al. | 4/579 |
| 2,322,147 | A | * | 6/1943 | Landauer | 4/574.1 |
| 2,588,562 | A | * | 3/1952 | Parish | 4/579 |
| 3,295,146 | A | * | 1/1967 | Martin et al. | 4/575.1 |
| 3,346,885 | A | * | 10/1967 | Merriman | 4/566.1 |
| 4,133,575 | A | * | 1/1979 | Mader | 296/95.1 |
| D267,969 | S | * | 2/1983 | Rodger | D6/349 |
| D278,580 | S | * | 4/1985 | Collins | D6/349 |
| 4,703,569 | A | * | 11/1987 | Bowman | 40/745 |
| 4,811,310 | A | * | 3/1989 | Wille | 367/173 |
| 4,939,799 | A | * | 7/1990 | Van Hovel | 4/578.1 |
| 4,955,093 | A | * | 9/1990 | Klassen | 4/579 |
| 4,975,991 | A | * | 12/1990 | Peterson | 4/579 |
| 5,090,068 | A | * | 2/1992 | Zellner | 4/578.1 |
| 5,475,880 | A | * | 12/1995 | Guenther | 4/578.1 |
| 5,491,850 | A | * | 2/1996 | Kiester | 4/572.1 |
| 5,606,751 | A | * | 3/1997 | Baker | 4/560.1 |
| 5,657,954 | A | * | 8/1997 | Emery et al. | 248/221.12 |
| 5,784,728 | A | * | 7/1998 | Weddendorf et al. | 4/579 |
| 6,067,670 | A | * | 5/2000 | Eddy et al. | 4/575.1 |
| 6,134,723 | A | * | 10/2000 | Benson | 4/579 |
| 6,195,813 | B1 | * | 3/2001 | Orcini | 4/578.1 |
| 6,226,810 | B1 | * | 5/2001 | Weddendorf et al. | 4/579 |
| 6,804,842 | B1 | * | 10/2004 | Johnson | 4/578.1 |
| 6,817,045 | B1 | * | 11/2004 | Fainberg | 4/605 |
| 6,908,138 | B2 | * | 6/2005 | Yang | 296/95.1 |
| 7,527,567 | B2 | * | 5/2009 | Ohle | 473/422 |
| 2006/0175365 | A1 | * | 8/2006 | Sandler | 224/201 |

* cited by examiner

*Primary Examiner* — David Dunn
*Assistant Examiner* — Richard Lowry
(74) *Attorney, Agent, or Firm* — Daniel Kirshner

(57) ABSTRACT

A bathtub seat that includes a platform upon which a bather sits formed from a plurality of watersealed planks. The planks are chosen of an appropriate length which length corresponds to the width of the bathtub. The platform planks are attached to feet, which feet rest on the top of the bathtub. The back edge of the platform includes a guide rail with a guide slot. The guide slot is utilized to position suction cups which suction cups are employed to adhere the platform to the back wall above the bathtub. Attached to the back of the suction cups are studs and nuts, which are used to attach the suction cups to the guide rails. The suction cups are positioned along the guide rails by loosening the stud from the nut, moving the suction cup along the guide slot and thereupon re-tightening. Once the suction cups are positioned appropriately for the particular application, the bathtub seat is positioned over the bathtub with the feet on the top of the tub. The suction cups are moistened and adhered to the back wall above the tub.

1 Claim, 5 Drawing Sheets

BATHTUB SEAT

FIELD OF THE INVENTION

The present invention is a bathtub seat. More specifically, the present invention bath seat includes a platform for the bather to sit upon which platform is attached to the wall above the bathtub using suction cups.

SUMMARY OF THE INVENTION

The present invention is a bathtub seat. The bathtub seat includes a platform upon which a bather sits formed from a plurality of watersealed planks. The planks are chosen of an appropriate length which length corresponds to the width of the bathtub. The platform planks are attached to feet, which feet rest on the top of the bathtub. The back edge of the platform includes a guide rail with a guide slot. The guide slot is utilized to position suction cups which suction cups are employed to adhere the platform to the back wall above the bathtub. Attached to the back of the suction cups are brass studs and nuts, which are used to attach the suction cups to the guide rails. The suction cups are positioned along the guide rails by loosening the stud from the nut, moving the suction cup along the guide slot and thereupon re-tightening. Once the suction cups are positioned appropriately for the particular application, the bathtub seat is positioned over the bathtub with the feet on the top of the tub. Now the suction cups are moistened and adhered to the back wall above the tub. The bather may now sit upon the platform of the bath seat and enjoy his or her bath. To remove the bath seat, a user tugs on the removal tongues on the suction cups thereby breaking the suction.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
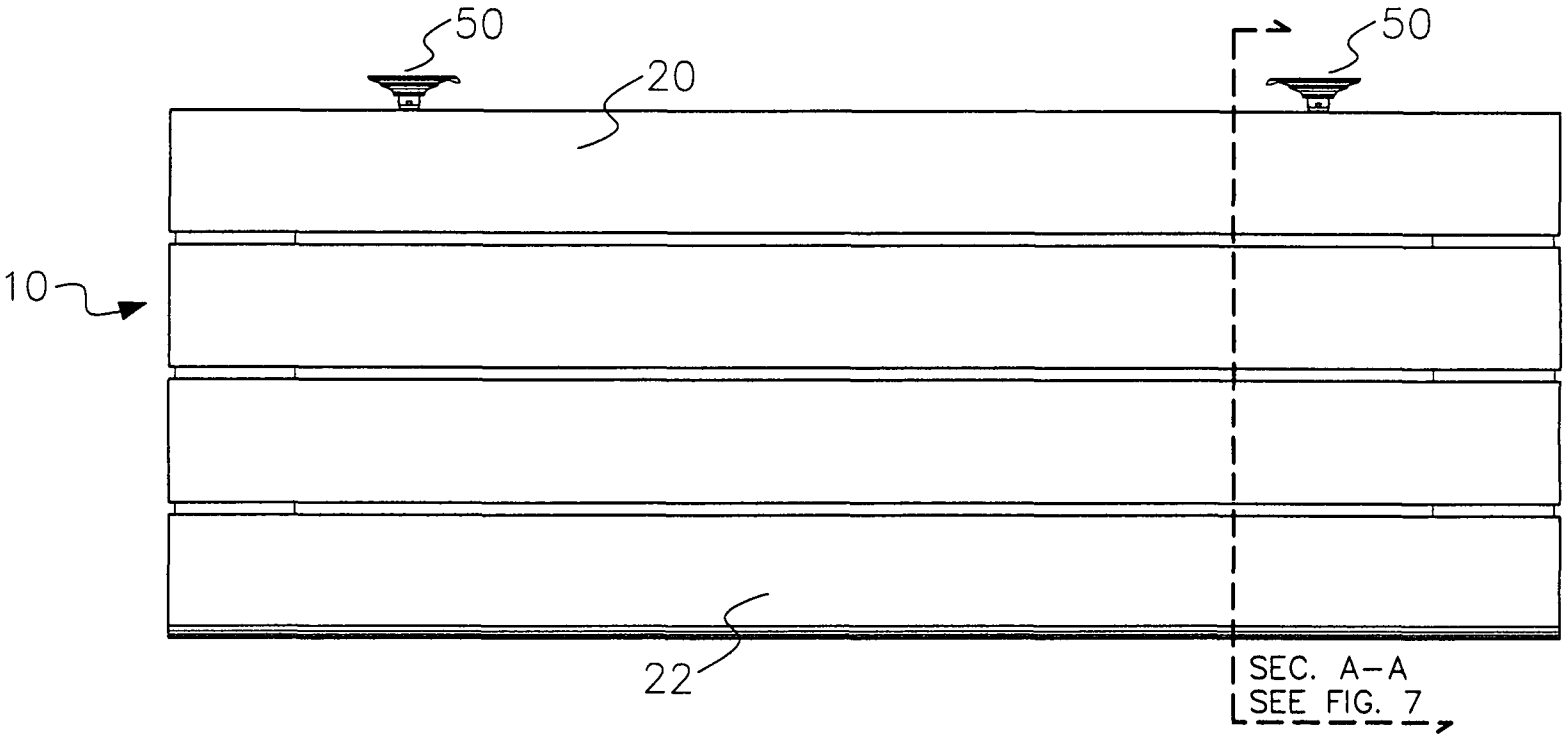
FIG. 1 is top view of the present invention bath seat.
Figure 2:
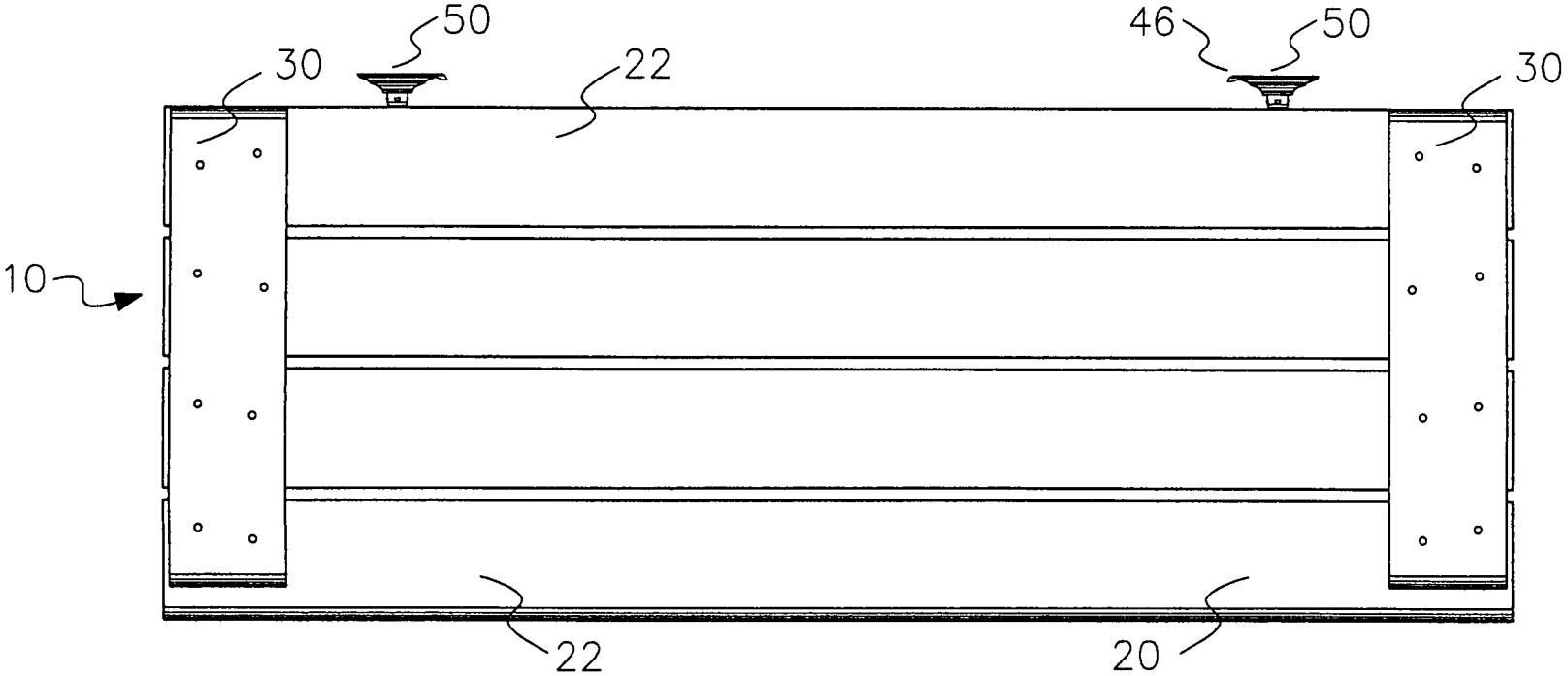
FIG. 2 is bottom view of the present invention bath seat.
Figure 3:
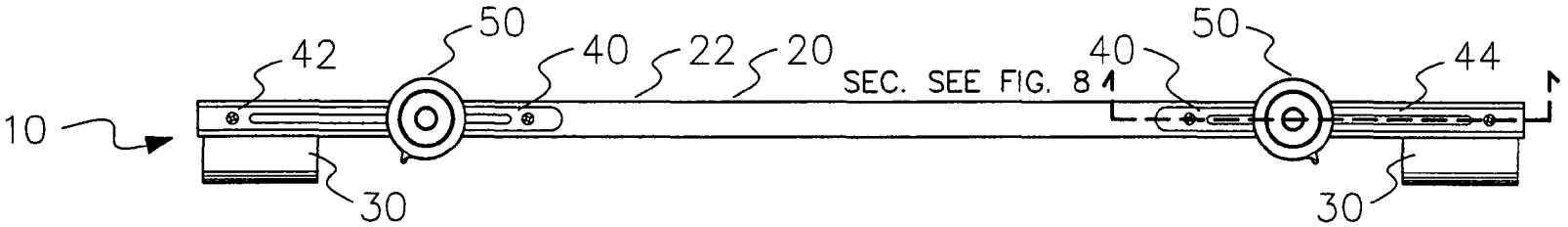
FIG. 3 is rear view of the present invention bath seat.
Figure 4:
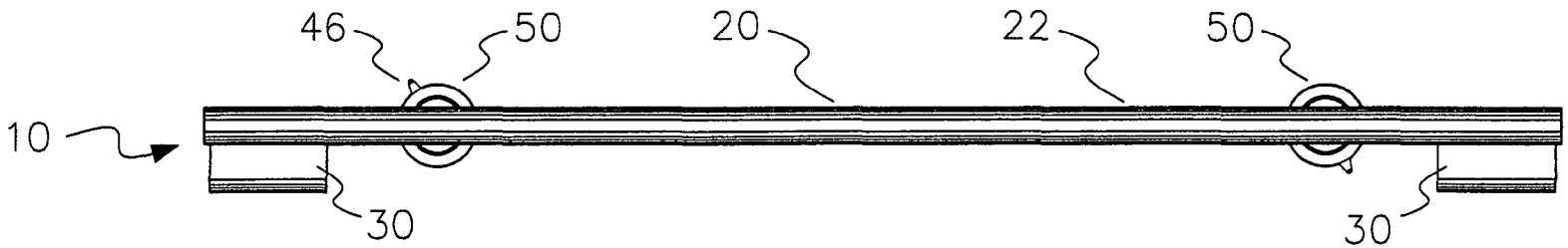
FIG. 4 is a front view of the present invention bath seat.
Figure 6:
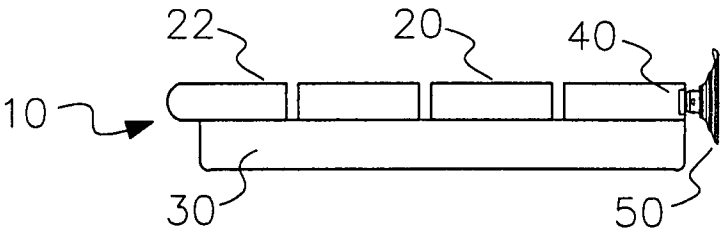
FIG. 6 is right side view of the present invention bath seat.
Figure 5:
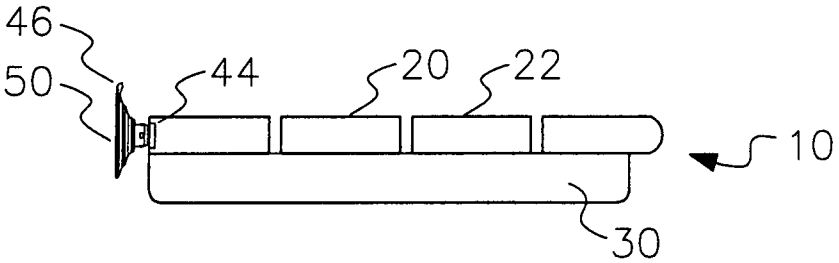
FIG. 5 is left side view of the present invention bath seat.
Figure 8:
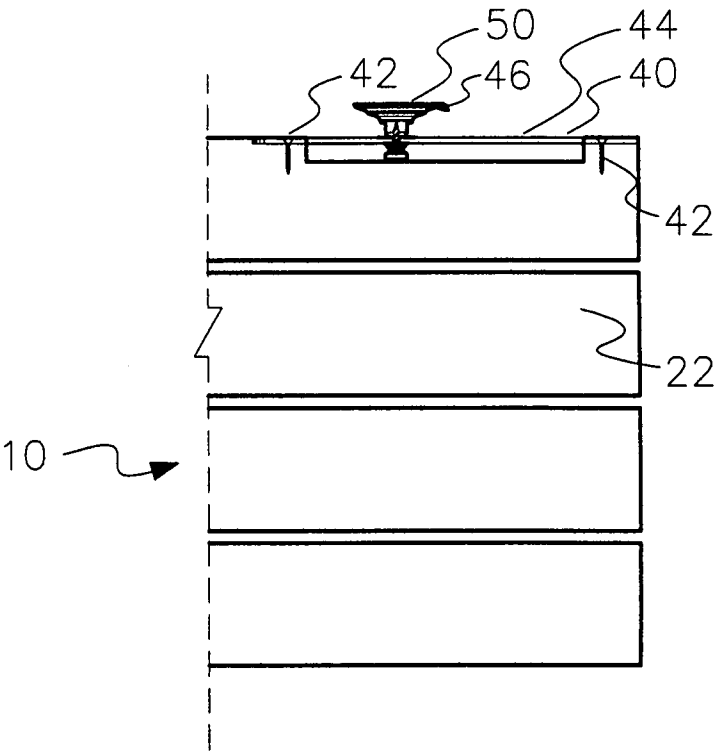
FIG. 8 is a partial longitudinal section view of the present invention bath seat taken along line B-B in FIG. 3.
Figure 7:
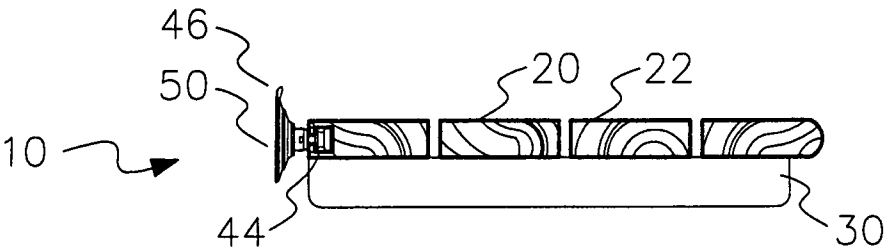
FIG. 7 is a cross-sectional view of the present invention bath seat, the section taken along line A-A in FIG. 1.

The present invention is a bath seat 10 which is attached to the wall above a standard household bathtub which permits a bather to sit thereupon while bathing. As is known in the prior art, a typical household bathtub has side walls that are spaced apart by a predetermined distance. Furthermore, the prior art bathtub is typically positioned in the bathroom of a house and the back of the tub is located against a back structural wall. The present invention bathtub seat comprises generally a seating platform 20, feet 30, suction-cup guide rails 40, and suction cups 50 for attachment to the wall.

In the embodiment shown in the figures, the seating platform 20 upon which the bather sits is 29" long which roughly corresponds to the width of a typical household bathtub and has a width of 10¾". To accommodate bathtubs of varying sizes, varying sized platforms may be chosen. The platform, as shown, is constructed from four ¾" planks 22 of hardwood each having a typical width of 2½". The planks are spaced with a gap of approximately ¼" between each plank and the planks are water-sealed for water protection. The plank at the front of the platform includes a ¼" radius bullnose edge.

To form the platform 20, the planks are nailed to the feet 30 and the attachment is further strengthened utilizing waterproof glue. Typically, 18 GA 1.5" galvanized nails are employed. The feet are 1"×2½"×10" planks of watersealed wood wherein the edges include a ¼" radius bullnose. The feet are positioned substantially perpendicular to the planks of the platform and at or near the ends of the planks, and are attached to the bottom surface of the platform. As such, when the bath seat is positioned over the bath tub, the feet will rest on the top of the bathtub's side walls.

Although the invention as presently disclosed shows the use of a seating platform comprising a plurality of wooden planks, the platform may take other embodiments. For example, the platform may be a single piece of watersealed lumber. Moreover, the seating platform may be formed from molded plastic, metal, or other such rigid materials.

Two suction-cup guide rails 40 are provided which are counter-sunk into the back edge of the platform 20, where the back edge of the platform is the edge that is positioned adjacent to the wall above the bath tub. The suction-cup guide rails are formed from aluminum plating measuring ⅛"×½"×8" and are attached to the back edge of the platform employing screws 42. Guide slots 44 measuring 5½" L×3/16" W×½" D are formed into the guide rails. In the embodiment shown, the guide rails are counter-sunk into the plank at the back edge of the platform so that the top surface of the guide rails are substantially flush with the back edge of the back plank. In a second embodiment, the guide rails are not counter-sunk. Instead, in this embodiment the guide rails are positioned away from and parallel to the back edge of the plank at the rear of the platform, spaced therefrom utilizing plastic spacers, and screwed to the plank.

Two off-the-shelf, prior art plastic suction cups 50 are provided which have an approximate diameter of 1¾". Attached to the back of each suction cup is a #8-32 brass stud, and a corresponding brass nut is provided. It will be appreciated that the heads of the brass nuts are larger that the width of the guide-rail slots 44 so they will not pass through the slots. As such, the suction cups are attached to the platform in the following manner. The brass nuts are positioned behind the guide rails. Now, the stud is inserted through the guide slots 44 and screwed into the nuts. Each suction cup may be selectively positioned anywhere along the guide-rail slots by tightening the stud with the attached suction cup into the nut. To re-position either of the suction cups, the suction cup is rotated counter-clockwise to loosen the nut partially, the suction cup slides along the guide-rail slot to the desired position, and the suction cup is now rotated clockwise to re-tighten. Each suction cup includes a removal tongue 46, which facilitates removal of the suction cup from the wall to which it adheres. To remove a suction cup, the user pulls on the removal tongue thereby breaking the suction and loosening it from the wall.

Although the preferred embodiment shown in the figures discloses the employment of two suction cups, it is within the confines of this disclosure to utilize one, or more than two suction cups. Of course, in this instance, corresponding guide rails with guide slots are provided. Moreover, rather than employing multiple guide rails with guide slots, the platform may be outfitted with one guide rail that extends the length of the back of the platform.

To utilize the present invention bath seat, a user places the bath seat on the bathtub wall adjacent to the back wall. Now, the positions of the suction cups are adjusted in the guide slots. To do so, the user loosens the suction cup in the guide slot by rotating the suction cup counter-clockwise thereby loosening the stud from the nut. When the desired position is achieved, the suction cup is rotated clockwise to tighten the stud into the nut and locking the suction cup into position in the guide slot. Thereafter, the same procedure is accomplished with the second suction cup to properly position it. Now, the suction cups are moistened to insure proper suction and they are positioned against the wall, pressed to it firmly and thereby adhered to the wall. At this time, the bather may sit upon the bath seat of the present invention to enjoy his or her bath. To remove the bath seat from the wall, the user tugs on the removal tongue of the suction cup, thereby breaking the suction.

The foregoing is considered as illustrative only of the principles and preferred embodiment of the invention. Furthermore, since numerous changes and modifications will readily occur to one skilled in the art, it is not desired to limit the invention to the exact construction, operation and embodiment shown and described, and accordingly all suitable modifications and equivalents may be resorted to, falling within the scope of the invention.

What is claimed:

1. A bathtub seat for placement onto the top of side walls of a bath tub, said side walls separated a predetermined distance, said bathtub seat being attached to a wall above the bathtub, said bathtub seat for supporting a person, comprising:

a seating platform formed from a plurality of planks and having a bottom surface and a back edge, said platform having feet attached to and extending perpendicularly downward from said bottom surface of said platform, said feet spaced apart a predetermined distance chosen to rest upon the side walls of the bathtub;

a guide rail attached to said back edge of said platform, said guide rail including a guide slot wherein said guide slot is utilized to position a plurality of circular suction cups, wherein said guide rail is counter-sunk into said back edge of said platform;

the plurality of moveable circular suction cups having backs and studs attached to said backs, wherein said studs are inserted through said guide slot and screwed into nuts, thereby allowing a user to adjust the position of said suction cups relative to said guide slot positioned on said back edge of said seating platform;

whereby said feet of said bathtub seat are positioned upon the side walls of a bathtub, said suction cups positioned relative to said guide slot, said suction cups attached to a wall above said bathtub thereby attaching said bathtub seat to a wall when said bathtub seat is in use.

* * * * *